US005988315A

United States Patent [19]

Crane

[11] Patent Number: 5,988,315

[45] Date of Patent: Nov. 23, 1999

[54] FALL ARREST SAFETY HARNESS AND TOOL BELT

[76] Inventor: Robert Crane, 1800 Cooper #1, Missoula, Mont. 59801

[21] Appl. No.: 08/772,930

[22] Filed: Dec. 24, 1996

[51] Int. Cl.[6] ..... A47L 3/04

[52] U.S. Cl. ..... 182/3

[58] Field of Search ..... 182/3, 4, 5, 6, 182/7; 119/857; 224/255, 257, 259; 244/151 R; 297/464, 465, 466, 467

[56] References Cited

U.S. PATENT DOCUMENTS

| | | | |
|---|---|---|---|
| 469,444 | 2/1892 | Frazier | 224/674 |
| 634,604 | 10/1899 | Ache | 182/3 |
| 1,636,459 | 7/1927 | Chappel | 182/3 |
| 1,642,911 | 9/1927 | Thurnau | 182/3 |
| 2,130,724 | 9/1938 | Lewis | 182/3 |
| 2,149,803 | 3/1939 | Wight | 224/259 |
| 2,208,990 | 7/1940 | Lewis | 182/3 |
| 2,574,178 | 11/1951 | Haller | 182/3 |
| 2,699,284 | 1/1955 | Rose | 227/49 |
| 2,887,286 | 5/1959 | Moran | 244/151 R X |
| 3,004,519 | 10/1961 | Weissman | 119/96 |
| 3,184,883 | 5/1965 | McCook | 224/639 |
| 3,321,247 | 5/1967 | Dillender | 182/3 X |
| 3,424,134 | 1/1969 | Rosenblum | 182/3 |
| 3,559,932 | 2/1971 | Ternes | 244/151 R |
| 4,103,758 | 8/1978 | Himmelrich | 182/3 |
| 4,390,116 | 6/1983 | Fehr | 224/209 |
| 4,512,437 | 4/1985 | Savage | 182/3 |
| 4,600,134 | 7/1986 | Colby | 224/260 |
| 4,923,105 | 5/1990 | Snyder | 224/255 |
| 4,938,436 | 7/1990 | Bradley et al. | 244/151 R |
| 5,024,360 | 6/1991 | Rodriguez | 224/215 |
| 5,067,585 | 11/1991 | Bell | 182/7 |
| 5,080,191 | 1/1992 | Sanchez | 182/3 |
| 5,201,448 | 4/1993 | Schue | 224/253 |
| 5,301,371 | 4/1994 | Chao | 297/464 X |
| 5,325,818 | 7/1994 | Leach | 182/3 X |
| 5,329,884 | 7/1994 | Bell | 182/3 X |
| 5,349,706 | 9/1994 | Keer | 2/300 |
| 5,360,082 | 11/1994 | Bell | 182/3 |
| 5,361,953 | 11/1994 | Nichols | 224/198 |
| 5,413,262 | 5/1995 | Dewire et al. | 224/253 |
| 5,435,272 | 7/1995 | Epstein | 119/857 X |
| 5,531,292 | 7/1996 | Bell | 182/6 X |
| 5,630,536 | 5/1997 | Bugnaski | 224/259 X |

*Primary Examiner*—Daniel P. Stodola
*Assistant Examiner*—Richard M. Smith
*Attorney, Agent, or Firm*—Dowrey & Associates

[57] ABSTRACT

A safety harness and tool belt is composed of a safety body harness and a tool belt carried by the harness. The harness comprises a waist strap, a single back strap extending from a shoulder apex downward in two segments, the segments being adapted to extend through the wearer's crotch to support the wearer in fall arrest, a single shoulder strap loosely engaging the back strap at its shoulder apex and extending from the shoulder apex over the wearer's shoulders in two chest segments to allow free shoulder movement, a pair of chest straps each connectable to one of the shoulder strap segments and to one of the back strap segments at the front of the wearer's torso so that the back strap is connectable to the shoulder strap chest segments to define a fall arrest sling that extends across the wearer's chest, shoulders and back and between the wearer's legs, and around a wearer's waist. The tool belt comprises at least a waist band connected to the harness waist strap and may also include tool pouches detachably mounted to the waist band.

16 Claims, 7 Drawing Sheets

4
3
116
1
1
102
118
2
3
114
116
1
3
4
102
4
114
116
118
2
2
118
102
114
102

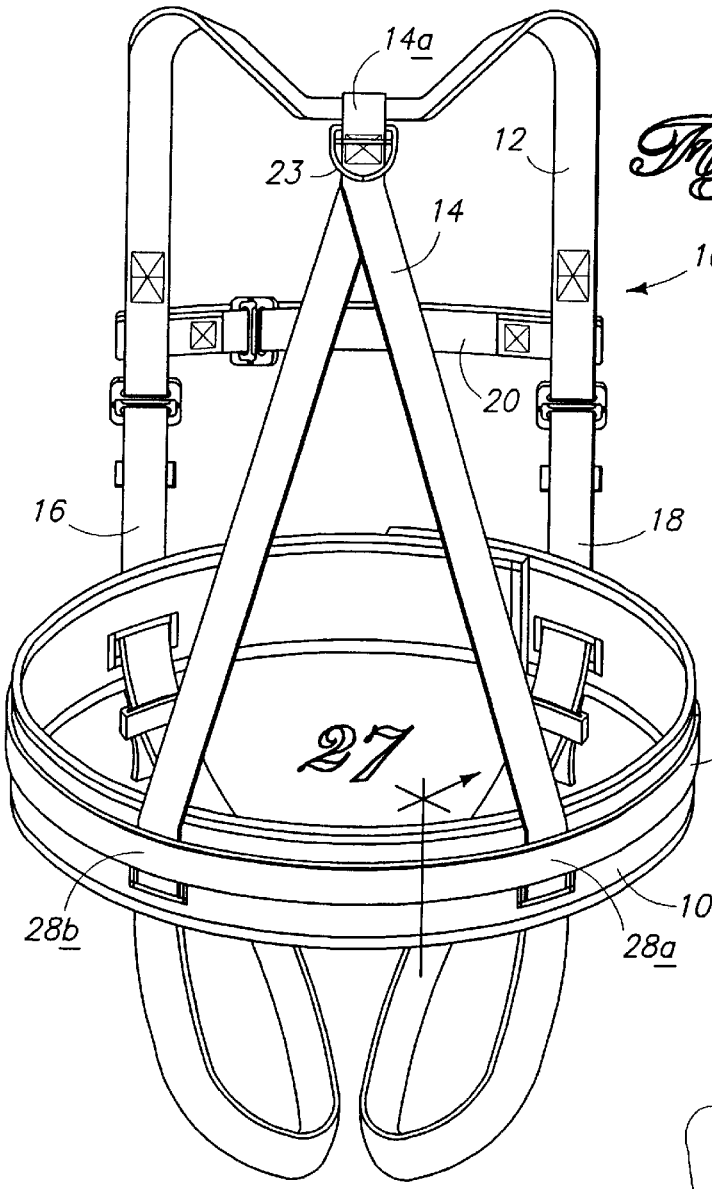
Fig 25
Fig 26
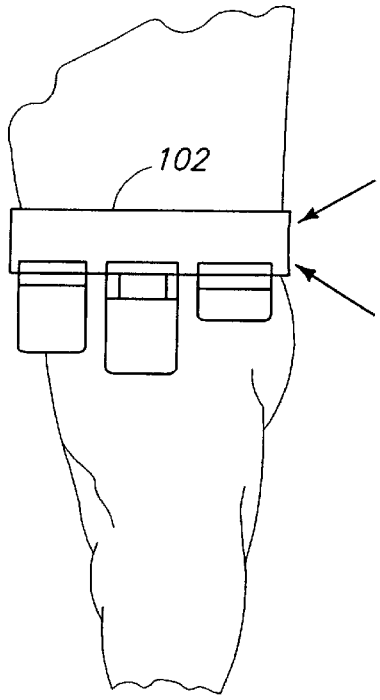
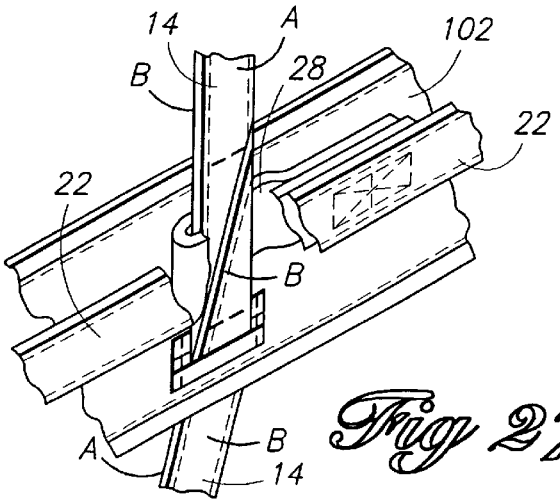
Fig 27

FALL ARREST SAFETY HARNESS AND TOOL BELT

BACKGROUND OF THE INVENTION

1. Field of the Invention

This invention relates to safety harnesses worn by workman to arrest falls. This invention also relates to tool belts supported by shoulder harnesses.

2. Brief Description of the Prior Art

Workman that work in elevated areas where they may fall wear body harnesses to protect them against falls. A particular type of fall arresting body harness is called a "fall arrest harness" because it is specially designed to hold a fallen workman, suspended by a safety lanyard attached to the harness. A suitable fall arrest harness extends across the workman's shoulder, down around his back, around his thighs, and around his waist; hence it is a body harness. A suitable fall arrest harness includes appropriate buckles so that the workman can adjust the harness to his body and so that he can remove or install the harness, and also includes an appropriate coupling attachment for connection to a safety lanyard.

In addition to wearing a body harness when working in elevated areas, a typical workman will often wear a tool belt having various pouches for holding tools, materials or supplies. For example, a carpenter working above ground while framing a building structure would typically need to have a hammer, nails, measuring tape, etc. handy while working in the elevated area. Therefore, that workman would typically wear a tool belt hung around his waist that would be fitted with appropriate pouches to hold or carry the necessary implements and materials.

Wearing both a safety harness and a tool belt is cumbersome and awkward. Typically, the safety harness would be applied first and the tool belt strapped on over the harness. The tool belt may interfere with achieving a comfortable fit of the harness. A workman may forego wearing a safety harness when requiring a tool belt, to reduce discomfort or to simplify moving around an elevated area.

SUMMARY OF THE INVENTION

This invention combines a safety body harness with a tool belt into one assembly. Consequently, neither element—the harness or the tool belt—need interfere with the other or with the convenience or comfort of one or the other element of the assembly. The body harness element of the invention is designed to meet fall arrest requirements. The body harness element is independent of the tool belt element, so that the tool belt will not interfere with the functioning of the harness. The body harness element, however, carries the tool belt element, enabling the workman to adjust the harness element and the tool belt element to a variety of positions to meet his own comfort needs. For example, the tool belt can be snugged around the workman's waist and support by the workman's hips, with the harness element secured to provide fall arrest but not supporting the weight of the tool belt element. Alternately, the harness element could be adjusted to carry all or a portion of weight of the tool belt element, with the tool belt element being snug or not snug around the workman's waist.

The tool belt element of the assembly of this invention is designed to enable a variety of tool, material or supplies pouches to be detachably connected to the tool belt. Consequently, the configuration of the tool belt element, insofar as concerns its capability to hold various tools, materials or supplies, can be adapted to the needs of the workman. This adaptability of the tool belt element does not interfere with the functionality of the harness element.

These objects and advantages will become apparent from the following description of the invention.

In accordance with these objects and advantages, the invention comprises: a safety harness and tool belt composed of a safety body harness and a tool belt carried by the harness. The harness comprises strap means for supporting a wearer about the wearer's back, shoulders, waist and legs for arresting a fall when suspended from a safety lanyard, and connecting means carried by the strap means for connecting the strap means to the safety lanyard. The tool belt comprises at least a tool belt waist band means carried by the harness, the waist band means being unintegrated into the strap means so that the strap means is independently sufficient to provide for fall arresting apart from the waist band means. The strap means of the harness comprises a single back strap extending from a shoulder apex downward in two segments, the segments being adapted to extend through the wearer's crotch to support the wearer in fall arrest; a single shoulder strap loosely engaging the back strap at its shoulder apex and extending from the shoulder apex over the wearer's shoulders in two chest segments to allow free shoulder movement; first connecting means connectable to one of the shoulder strap segments and to one of the back strap segments at the front of the wearer's torso, and second connecting means connectable to the other shoulder strap segment and to the other back strap segment at the front of the wearer's torso, so that the back strap is connectable to the shoulder strap chest segments to define a fall arrest sling that extends across the wearer's chest, shoulders and back and between the wearer's legs, and around the wearer's waist. The strap means of the harness includes a waist strap and waist strap connectors connecting the waist strap to the back strap and to the first and second connecting means.

BRIEF DESCRIPTION OF THE DRAWINGS

FIG. 25 is a rear view of the harness and tool belt portions of the FIG. 1 assembly;

FIG. 26 is a diagrammatic view of the tool belt of the FIG. 1 assembly providing lower back support;

FIG. 27 is a detail view of the strap crossover through the back shoulder strap portion taken along the line 27—in FIG. 25;

DESCRIPTION OF THE PREFERRED EMBODIMENT

Figures 1, 2, 32, 33:
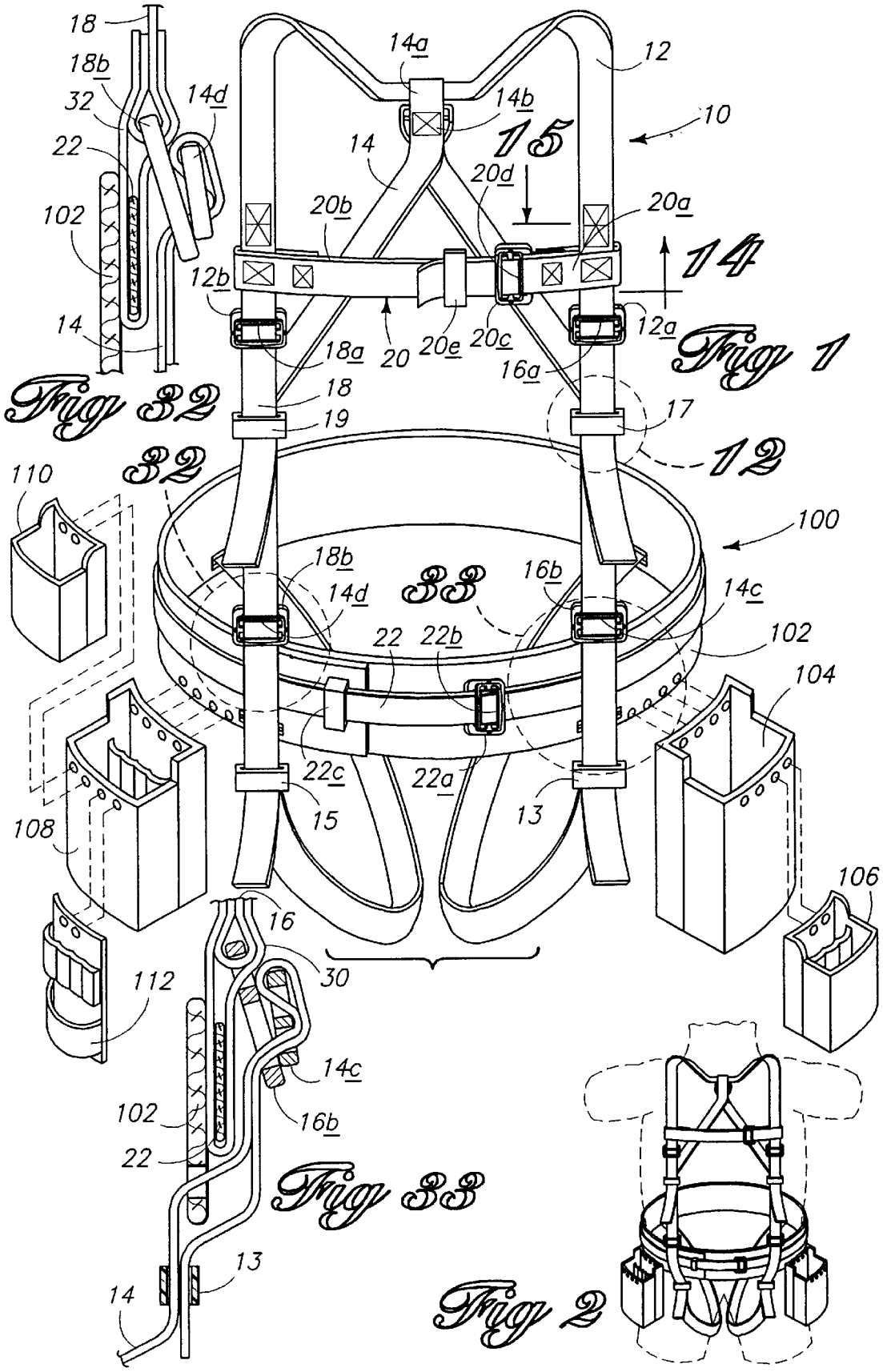
FIG. 1 is an exploded isometric view of the harness and tool belt assembly of this invention, with various accessory pouches illustrated.
FIG. 2 is an isometric view of the FIG. 1 assembly applied to a person's body.
FIG. 32 is a detail view of the leg strap portion connected to the front shoulder strap portion by an easy pass buckle taken from detail 33 in FIG. 1.
FIG. 33 is a detail view of the FIG. 32 connection showing the extension of the leg strap portion through the belt slot and the extension of the leg strap portion free end across the belt slot and fastened by a strap free end keeper below the belt.

The safety harness and tool belt assembly of this invention comprises a safety harness element 10 and a tool belt element 100. The safety harness element 10 is composed of a shoulder strap 12, a back strap 14, two front chest straps 16, 18, a cross-chest strap 20, a waist strap 22 and various buckles, keepers and couplers. The tool belt element 100 is composed of at least a tool belt 102 and may include various detachable pouches, such as pouches 104, 106, 108, 110, 112 for holding tools, materials or supplies.

As shown particularly in FIGS. 1, 5, 6, 7, 25, 32 and 33, as well as in several other figures, the various straps of the safety harness element 10 are constructed and assembled in very particular ways.

Figure 5:
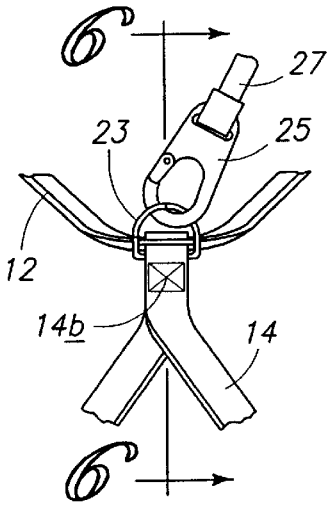
FIG. 5 is a partial rear view of the shoulder and back straps of the FIG. 1 assembly showing a fall arrest D-ring, safety hook and lanyard.
Figure 6:
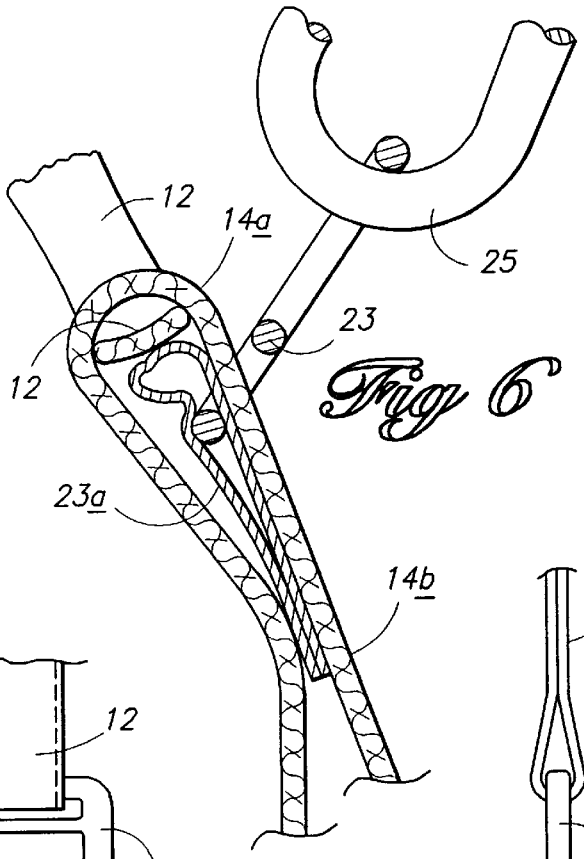
FIG. 6 is a detail view taken along the line 6—6 of FIG. 5.

Back strap 14 is a one-piece strap that is doubled over on itself at the middle to provide a loop 14*a* (FIG. 6) through which the shoulder strap 12 extends. Loop 14*a* is formed by the doubled over portion of back strap 14 being stitched to itself at 14*b* (FIGS. 1, 5). The ends of back strap 14 are each extended through an easy pass buckle insertion part, 14*c* or 14*d*, doubled through the buckle part, and secured to itself by a free end keeper, 13 or 15. The loop 14*a* is located at the apex of the back segments of the back strap 14. This apex is fixed at a position determined by the length of the back segments of the back strap that extend from the waist strap 22 to the loop 14*a*. Typically, this loop 14*a* would be positioned to reside between a user's shoulder blades so that the shoulder strap 12 would be caused to extend over and down along the back of the user's shoulders and neck. The loop 14*a* also locates an appropriate place for a fall arrest D-ring 23 to be attached to the harness element 10, FIGS. 5, 6 illustrating the D-ring 23 being fastened to a locking snap hook 25 at the end of a fall arrest lanyard 27. Safety regulations specify that the fall arrest connecting point of the D-ring be in the center of the wearer's back near the shoulders. A D-ring protecting liner 23*a* may be stitched into the loop 14*a* to prevent the D-ring 23 from pinching or binding the shoulder strap 12 within the loop 14*a*.

Figure 3:
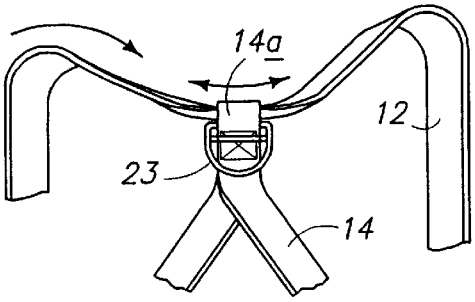
FIG. 3 is a partial rear view of the shoulder and back straps of the FIG. 1 assembly.
Figure 4:
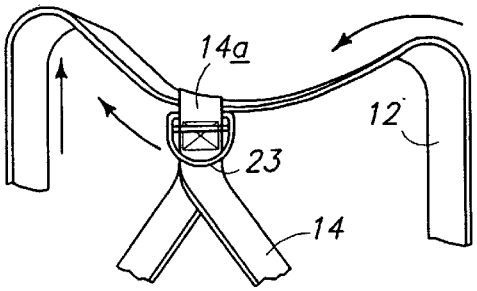
FIG. 4 is another partial rear view of the shoulder and back straps of the FIG. 1 assembly, similar to FIG. 3 but showing a range of shoulder strap movement.
Figure 7:
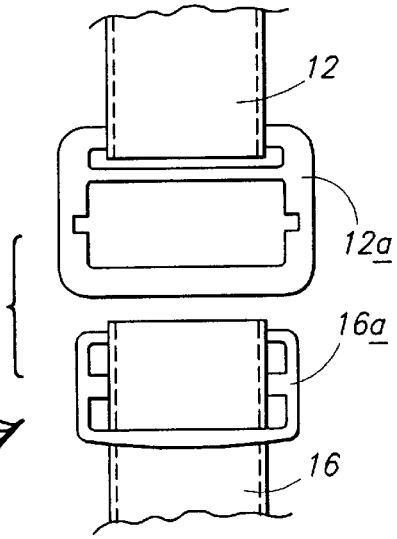
FIG. 7 is a front view of an easy pass strap connection buckle used in the FIG. 1 assembly.
Figure 8:
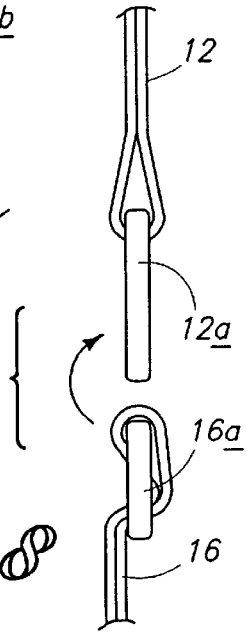
FIG. 8 is a side view of the FIG. 7 buckle.
Figure 9:
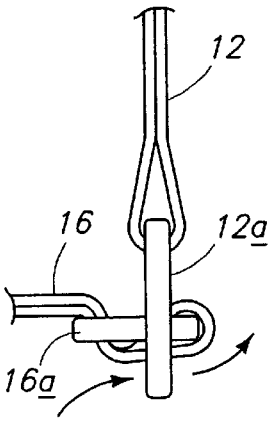
FIGS. 9–11 are sequence views illustrating the manner of coupling of the FIG. 6 buckle parts together.
Figure 10:
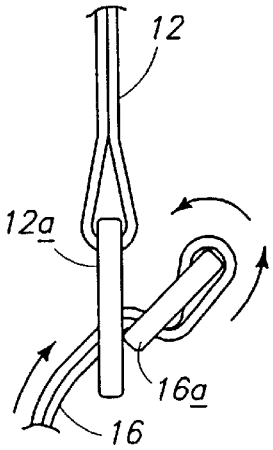
Figure 11:
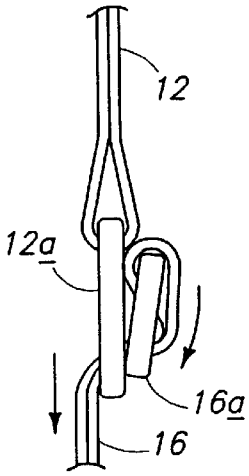
Figure 12:
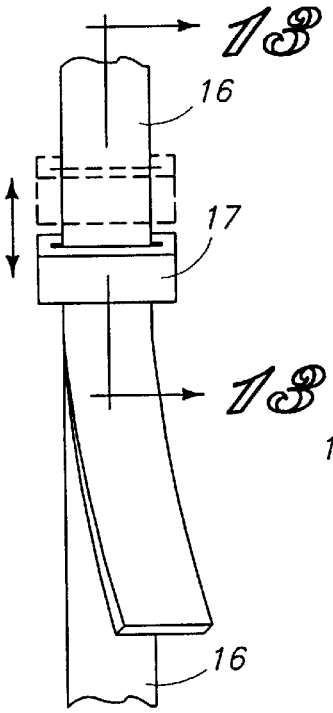
FIG. 12 is a front view of a strap free end keeper used in the FIG. 1 assembly.
Figure 13:
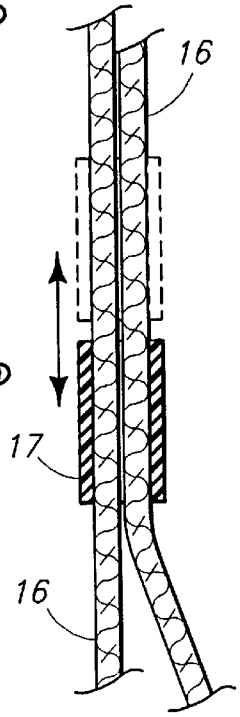
FIG. 13 is detail view taken along the line 13—13 of FIG. 12.

Shoulder strap 12 is a one-piece strap that extends through the loop 14*a* and is fitted with an easy pass buckle receptor part, 12*a* or 12*b*, at each strap end (FIGS. 1, 7). The ends of shoulder strap 12 are each extended through the buckle parts 12*a* or 12*b*, doubled back over, and stitched to themselves to retain the buckle parts as at 12*c* in FIG. 14. The upper end of each front chest strap 16, 18 is fitted with an easy pass buckle insertion part, 16*a* or 16*b* (FIGS. 1, 7), doubled back through the buckle part, and secured to itself by a free end keeper, 17 or 19 (eg. FIG. 12). The lower end of each front chest strap 16, 18 is fitted with an easy pass buckle receptor part, 16*b* or 18*b* (FIGS. 1, 32, 33), doubled back over, and stitched to itself to retain the buckle part. The one-piece nature of shoulder strap 12 and its extension through loop 14*a* in back strap 12 enables the shoulder strap to move back and forth through the back strap loop 14*a* when the user moves his shoulders up and down and around during work as exemplified in FIGS. 3–4. Consequently, this shoulder strap and back strap configuration allows movement to follow shoulder shifts to keep the harness from rubbing the user's shoulders.

The waist strap ends are provided with an easy pass buckle, one end having a receptor part 22*a*, the other end having an insertion part 22*b* and a free end keeper 22*c*; these members being assembled on the waist strap 22 in the same manner as heretofore described with respect to the other straps and their easy pass buckle parts.

Figure 14:
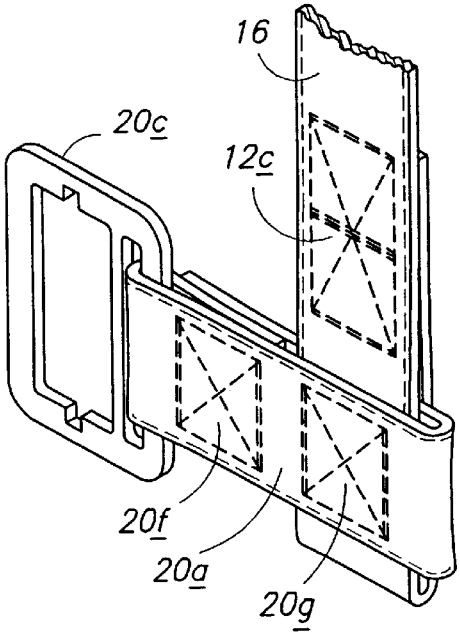
FIG. 14 is an isometric view of the left side chest strap connection to the left side shoulder strap of the FIG. 1 assembly, taken from the location of the line 14—in FIG. 1.
Figure 15:
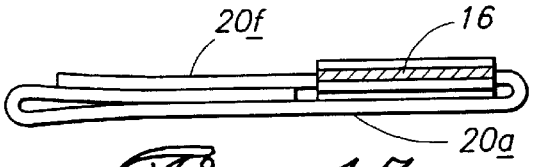
FIG. 15 is a detail view taken along the line 15—in FIG. 1 further illustrating the connection of FIG. 14.

Cross-chest strap 20 is a two-piece strap that extends between the shoulder straps 16, 18. One cross-chest strap segment 20*a* is stitched to shoulder strap 16 and the other segment 20*b* is stitched to shoulder strap 18. The stitched ends of the cross-chest strap segments 20*a*, 20*b* are doubled back to enclose the respective shoulder strap front segments (FIGS. 1, 14, 15) and stitched to one another and to the respective shoulder strap front segments as at 20*f* and 20*g*, respectively in FIG. 14. Likewise, the stitched ends of the shoulder strap 12 are doubled back to enclose the respective cross-chest strap segments as seen in FIG. 14 with respect to cross-chest strap segment 20*a*. Cross-chest strap segments 20*a*, 20*b* have free ends that are extended through easy pass buckle parts 20*c*, 20*d*. The free end of segment 20*a* is extended through the buckle receptor part 20*c*, doubled back over, and stitched to itself to retain the buckle part. The free end of the other segment 20*b* is doubled through the buckle insertion part 20*d*, and secured to itself by a free end keeper 20*e*.

Waist strap 22 is fastened to the back strap 14 at two locations and is fastened to each front chest strap. Fastenings in the form of strap loops are provided to connect the waist strap 22 to the vertical strap segments. FIG. 27 shows a horizontal strap loop 28 stitched to the waist strap 22 and enclosing the back strap 14. FIG. 33 shows a vertical strap loop 30 stitched to the vertical front chest strap 16 and enclosing the waist strap 22, and FIG. 32 shows a vertical strap loop 32 stitched to the vertical front chest strap 18 and enclosing the waist strap 22.

The horizontal strap loops 28 fix the locations at which the back strap 14 passes the waist strap 22 at 28*a* and 28*b* in FIG. 25. At these locations, 28*a*, 28*b*, the back strap 14 is twisted to reverse itself, front-to-back, so that the rear surface A above the waist strap becomes the front surface A below the waist strap, and so that the front surface B above the waist strap becomes the rear surface B below the waist strap. The reversed segments of the back strap at 28*a* and 28*b* are stitched to the horizontal loops 28. Because the back strap 14 extends from an apex at loop 14 downward and outward toward the waist strap 14 (FIG. 25), the twisted reversal of the back strap as shown in FIG. 27 reverses the direction of the back strap below the waist strap 22. The segments of the back strap 14 below the waist strap 22 are the strap segments that extend around the user's thighs, and this twisted reversal redirects the back strap 14 into appropriate directions for comfortably extending around a user's thighs.

The "easy pass" buckles referenced above and hereinafter are configured as shown in FIGS. 32 and 33 so that a free strap end is extended through the insertion part and doubled back through the insertion part in such a way that the doubled-over segments are passed—along with the insertion part—through the buckle receptor part. Consequently, the doubled-over segments are bound in the assembled buckle and will not slip, making the "easy pass" buckle especially suitable for use in a fall arrest harness assembly. The assembly of the easy pass buckle parts, with respect to the buckle part combination 12*a*/16*a* that joins straps 12 and 16, is illustrated in the sequence of figures in FIGS. 8–11.

The strap free-end keepers referenced above and hereinafter are provided to hold the free strap ends out of the way and against their respective straps. Furthermore, the free-end keepers will maintain the relative positions of the doubled-over strap segments when the buckle is disassembled, insuring that the location of the buckle insertion part on its strap will be maintained and thereby eliminating or minimizing the chance that the position of the insertion part might slip while the buckle is disassembled.

When a user puts on the harness element 10, the front chest straps 16, 18 will normally already be attached to the shoulder strap 12 through the receptor/insertion buckle part combinations 12*a*/16*a*, 12*b*/18*a*. The user will extend the ends of the back strap 14 through his crotch and around his thighs, from rear to front, and attach its insertion buckle parts 14*c*, 14*d* into the chest strap lower end buckle receptor parts 16*b*, 16*b*, respectively making up receptor/insertion buckle part combinations 14*c*/16*b*, 14*d*/18*b*. Either before or after the making up of the buckle part combinations 14*c*/16*b*, 14*d*/18*b*, the user will attach the ends of the waist belt 22 together by fastening the buckle parts 22*a*, 22*b* and will attach the cross-chest strap segments by fastening the buckle parts 20*c*, 20*d*. With the front chest straps 16, 18 already fastened to the shoulder strap 12, the harness element 10 can be applied like a jacket, with the user inserting his left arm between the back strap 14 and the left front segment of the shoulder strap 12, and inserting his right arm between the back strap 14 and the right front segment of the shoulder strap 12.

The tool belt 102 of the tool belt element 100 comprises a band that is stitched to the harness waist strap 22. The band is wider than waist strap 22 and thicker. The band is provided with a VELCRO hook pad 114 at one end and a VELCRO loop pad 116 at the other end, one pad being located on the outside surface of the band and the other on the inside surface so that the band ends can be overlapped and fastened together by the VELCRO hook and loop fastener. The harness waist strap 22 is stitched to the outside surface of the tool belt band. Appropriate horizontal rectangular slots 1,2,3 and 4 are provide along the length of the band to accommodate passage of the vertical harness strap segments through the band as shown in FIGS. 1, 26 and 16–20. As shown in FIG. 27, the waist strap 22 is fastened to the tool belt band by two parallel lines of stitching that are indicated by dashed lines on waist strap 22. Apart from this stitching, the tool belt band has no other connection to the harness element 10. Consequently, there will be no functional interaction between the harness element 10 and the tool belt band when the harness element 10 is called into action as a fall arrest harness; the tool belt band neither aids nor deters the functioning of the harness element 10 as a fall arrest harness. Although the vertical harness segments extend through the tool belt band, there is no interruption of the fall arrest connections throughout the harness element 10. The thigh segments of the back strap 14 extend through the tool belt band and connect directly to the lower buckle parts of the front chest straps 16, 18; the upper buckle parts of the front chest straps 16, 18 connect directly to the shoulder strap buckle parts; and the back strap segments extend through the tool belt band without interruption. There is no part of the harness element 10 that is weakened or compromised by the presence of the tool belt band. There is no joinder of strap segments that structurally involve the tool belt band.

However, the harness element 10 does functionally interact with the tool belt band to help support the weight of the tool belt element 100 and the weight of any items carried by the tool belt element 100. The length of the front chest straps 16, 18 can be adjusted so that the entire weight of the tool belt elements and its contents (an be carried by the shoulder and back straps 12, 14 or so that any portion of that weight can be so carried to relieve the user's hip and lumbar areas and disperse that weight to the user's shoulders. The waist strap 22 being carried by the front chest strap loops 30, 32 (FIGS. 32, 33) and the rear waist band loops 28 (FIG. 27), results in the tool belt band being carried by the harness straps also, with one exception. That exception will occur if the tool belt band is fastened tightly about the user's waist so that the tool belt band is supported by the user's waist, hips and back, with the harness straps lengthened so that there is some slack in the shoulder straps and front chest straps.

Figures 16, 17, 18, 19, 20:
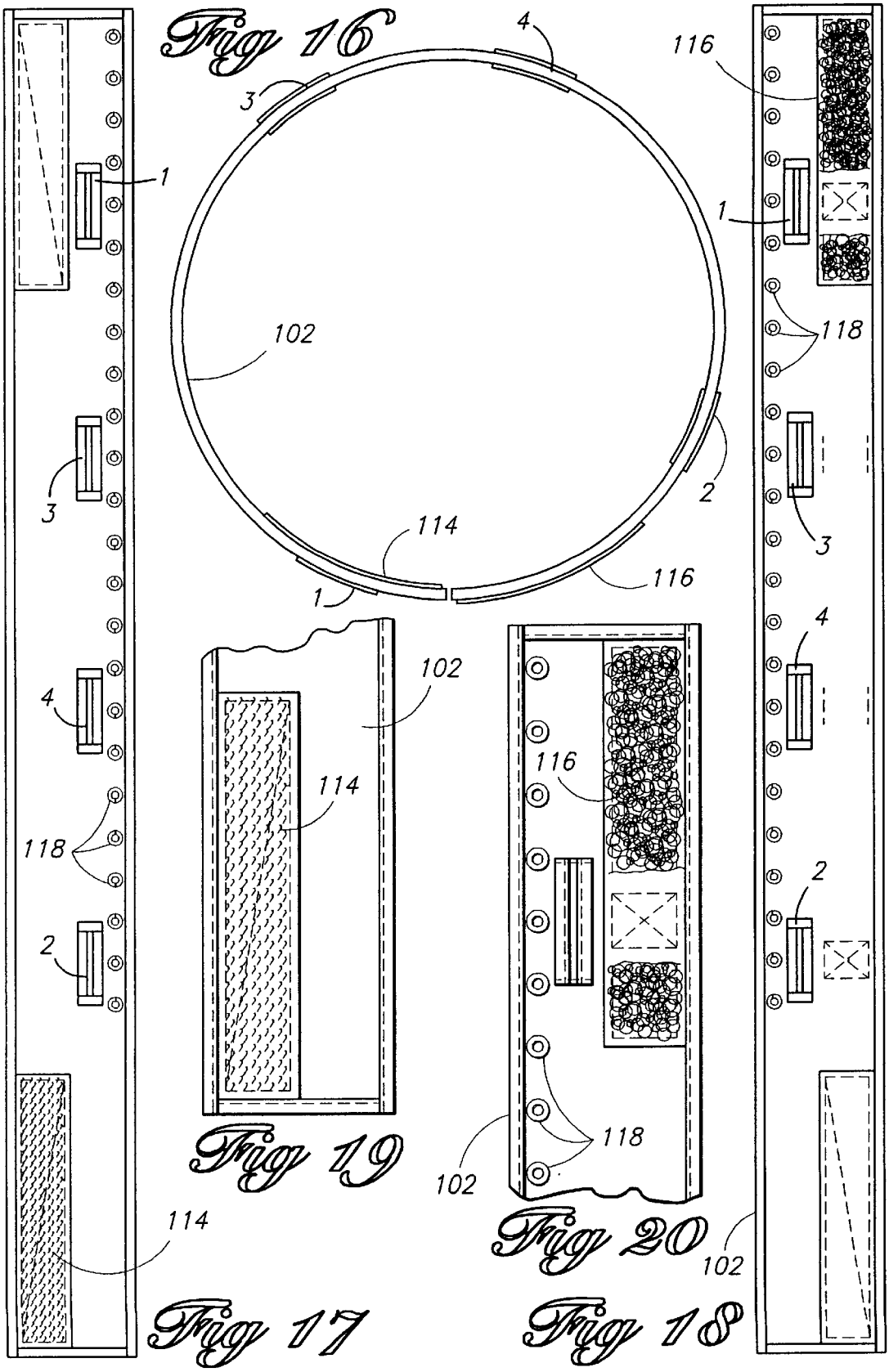
FIG. 16 is a top plan view of the tool belt of the tool belt element of the FIG. 1 assembly.
FIG. 17 is a front view of outside of the FIG. 16 tool belt.
FIG. 18 is a back view of the inside of the FIG. 16 tool belt.
FIG. 19 is a detail view of the VELCRO hook portion of the FIG. 16 tool belt.
FIG. 20 is a detail view of the VELCRO nap portion of the FIG. 16 tool belt.
Figure 21:
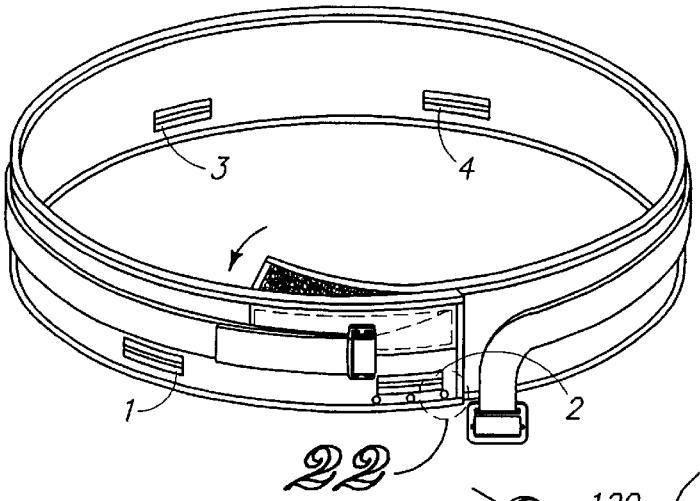
FIG. 21 is an isometric view of the FIG. 16 tool belt showing the VELCRO attachment of the belt ends in relation to the placement of harness strap slots.
Figure 22:
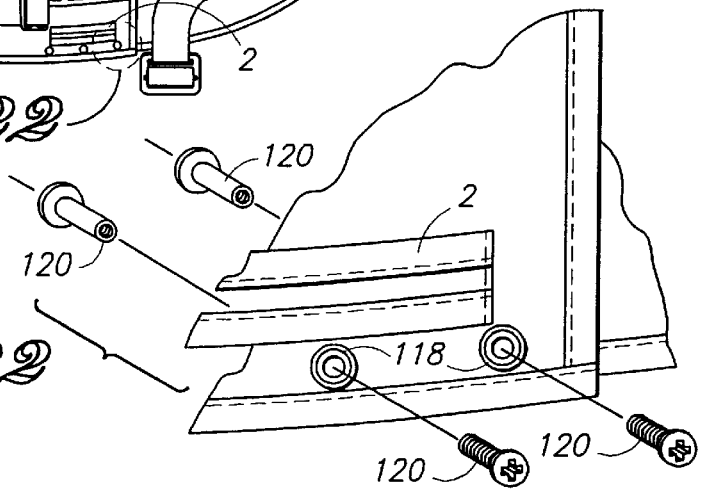
FIG. 22 is a detail view of the placement of grommets and screw posts for detachably connecting tool pouches to the FIG. 16 tool belt.
Figure 23:
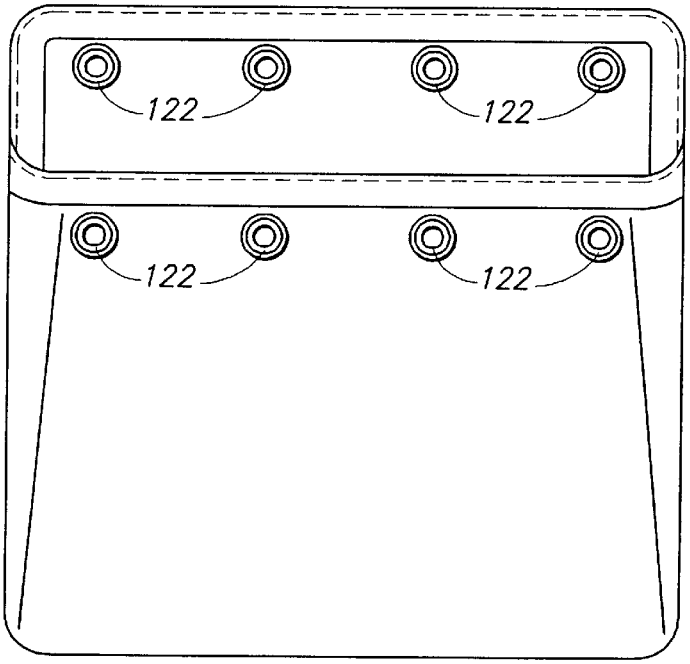
FIG. 23 is a front view of a typical tool, material or supplies pouch.
Figure 24:
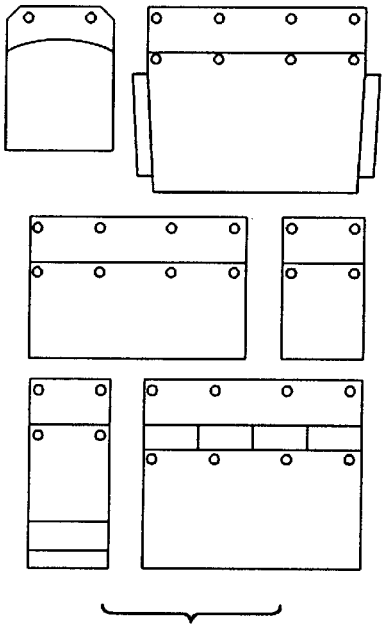
FIG. 24 is a diagrammatic view of various pouch accessories.
Figure 28:
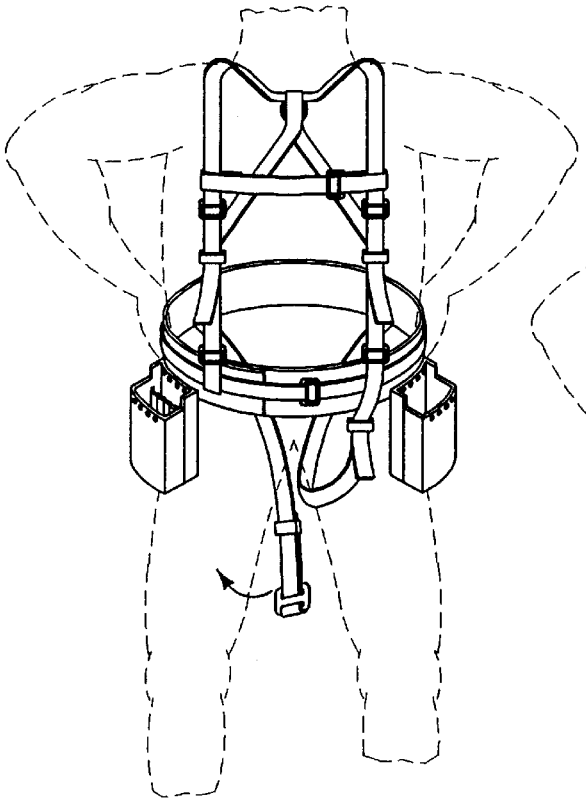
FIGS. 28–30 are sequence views illustrating the manner of coupling the leg strap portions of the harness element of the FIG. 1 assembly to the front shoulder strap portions.
Figure 29:
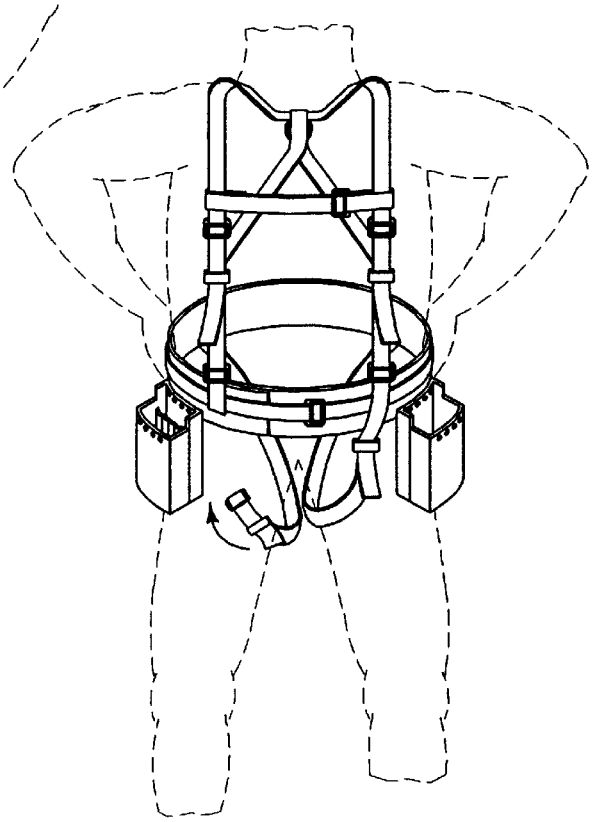
Figure 30:
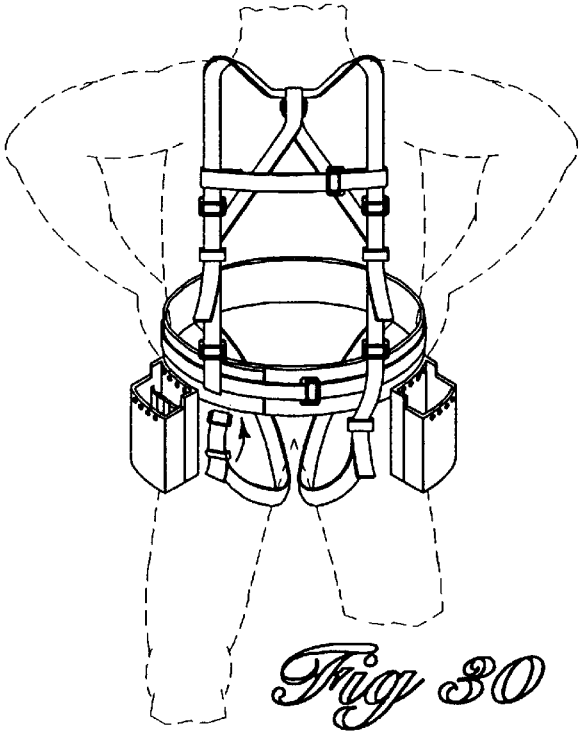
Figure 31:
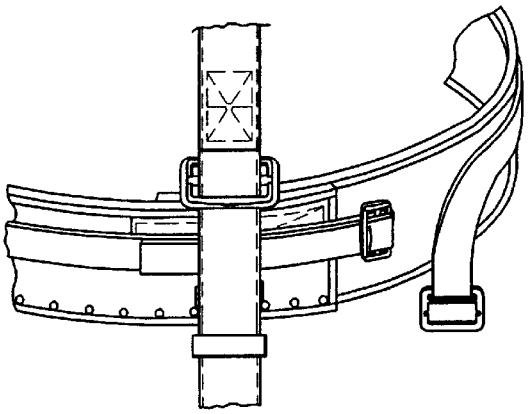
FIG. 31 is a detail view of the leg strap portion extending through the tool belt.

Along the lower edge of the tool belt waist band, a plurality of grommeted holes are provided as fastening points for attaching pouches, such as pouches 104, 106, 108, 110 and 112 of FIG. 1. These grommeted holes, as at 118 in FIGS. 17, 18, 22, are spaced apart at selected distances along the tool belt waist band. The spacing between the grommeted holes may be uniform or non-uniform. The pouches are provided with compatible grommeted holes, as at 120 in FIG. 22, at compatible spacings so that the pouches can be positioned almost anywhere around the tool belt that the user might prefer. Typically, the grommet holes would be located around the belt so as to encircle the wearer 360° from the point of maximum closure of the waist band. As seen in FIG. 1, also, some pouches such as pouches 104, 108 can be provided with additional grommeted holes so that auxiliary pouches such as at 106, 110 and 112 can be fastened to them.

It is preferable that all grommeted holes are spaced and configured so that pouches can be fastened directly to the tool belt band or to another pouch. Appropriate fasteners, such as screw posts 122 (FIG. 22), detachably mount the pouches to the tool waist band. Other forms of fasteners by which pouches could be detachably mounted to the tool belt band are known and could be appropriately substituted for the screw posts.

A significant feature of the structure of the tool belt 102 and its pouches is that the pouches are connected only to the tool belt waist band, and not to the harness waist strap 22. Consequently, the presence of the pouches or the weight of items carried by or in the pouches will not affect the waist strap 22 in its capacity of being part of the safety harness element 10. If, for example, the tool belt waist band and its pouches happened to be torn from the waist strap 22, the integrity of the waist strap as a part of the safety harness element 10 would not be affected. Equally importantly, the tool belt waist band and its pouches are not integrated into the back strap/shoulder strap/chest straps configuration of the harness element 10. Should it occur, therefore, that a workman fails to buckle the waist strap 22, this strap configuration would suffice to secure the workman in fall arrest should he fall while attached to a fall arrest lanyard. No portion of the tool belt waist band constitutes a joint or intermediate connection in this strap configuration, as evidenced by the fact that this strap configuration is the same whether the tool belt waist band is present or not in the overall assembly. The strap configuration carries the waist strap 22 and the tool belt waist band 102 is carried by the waist strap, not vice versa. The tool belt waist band 102 does not function, in relation to the harness waist strap 22, as a reinforcing band inasmuch as the harness waist strap 22 is sufficient in and of itself to independently provide its function as a part of the safety harness element 10.

The tool, material and supplies pouches, such as the pouches shown in FIG. 1 are called "pouches" as a short hand reference. These "pouches" are merely carrying elements that may be formed in any suitable configuration to hold any tool, material or supplies that a workman would desire to carry on a work belt. Tools such as hammers, screw drivers, nail sets, and the like, would not necessarily be carried in a pocket but might be carried by a sling or sleeve arrangement. Therefore, the term "pouch" is not intended to place any limitation on the structural form that the carrying element might take nor on the type or kind of articles that might be carried by such carrying elements. Typical tool pouches intended for use in construction work might provide for carrying screw guns, staples, nails, long tools or miscellaneous articles (perhaps a cellular phone), hammers, measuring tapes, razor knifes, speed squares, wallets, bolts, wrenches, rebar tools, pliers, and so forth.

The tool belt band may be provided with a lumbar support pad that is either incorporated into the band or that can be attached to the band, as by the application of grommeted holes and screw posts.

The straps of the safety harness element 10 may be suitably fabricated from 6000 lb. Nylon webbing or similar material. The tool belt waist band and its pouches may be suitably fabricated from 1000 denier Cordura or similar materials. The tool belt waist band may include a foam or similar padding incorporated into the band.

While the preferred embodiment of the invention has been described herein, variations in the design may be made. The scope of the invention, therefore, is only to be limited by the claims appended hereto.

The embodiments of the invention in which an exclusive property is claimed are defined as follows:

I claim:

1. A safety harness and tool belt which comprises a safety body harness and a tool belt carried by the harness for supporting tools and working supplies;

said harness comprising strap means establishing a continuous fall arrest connection for supporting a wearer about the wearer's back, shoulders, waist and legs for arresting a fall when suspended from a safety lanyard, and a safety lanyard connection carried by said strap means for connecting said strap means to the safety lanyard;

said strap means of said harness comprising a single back strap extending from a shoulder apex downward in two segments, said segments being adapted to extend through the wearer's crotch to support the wearer in fall arrest; a single shoulder strap loosely engaging said back strap at its shoulder apex and being adapted to extend from said shoulder apex over the wearer's shoulders in two chest segments; first connecting means connectable to one of the chest strap segments and to one of the back strap segments at the front of the wearer's torso, and second connecting means connectable to the other chest strap segment and to the other back strap segment at the front of the wearer's torso, so that said back strap is connectable to said shoulder strap chest segments to define a fall arrest sling that extends across the wearer's chest, shoulders and back between the wearers legs, and said tool belt comprising at least a tool belt waist band carried by said harness, said strap means having a free sliding connection with said waist band, said tool belt waist band being completely independent from the fall arrest function of the harness straps for establishing said continuous fall arrest connection so that said strap means is independently sufficient to provide for fall arresting apart from said waist band.

2. The safety harness and tool belt of claim 1 wherein said harness includes a releasable buckle means for joining said back and chest strap segments.

3. The safety harness and tool belt of claim 1 wherein said strap means of said harness includes a waist strap and waist strap connectors connecting said waist strap to said back strap and to said first and second connecting means.

4. The safety harness and tool belt of claim 3 wherein said waist band of said tool belt is connected to said waist strap.

5. The safety harness and tool belt of claim 1 wherein said tool belt includes at least one carrying element and mounting means detachably mounting said carrying element to said waist band.

6. The safety harness and tool belt of claim 5 wherein said waist band is provided with a plurality of grommeted holes spaced therealong and wherein said mounting means comprises screw posts extended through said grommeted holes and through said carrying element for securing said carrying element to said waist band.

7. The safety harness and tool belt of claim 1 wherein said first and second connecting means comprises first and second chest straps each connectable to one of said shoulder strap chest segments and each connectable to one of said back strap segments.

8. The safety harness and tool belt of claim 7 wherein said harness includes releasable buckle means for joining said first and second chest straps to said shoulder strap chest segments and to said first and second back strap segments.

9. The safety harness and tool belt of claim 8 wherein said waist band of said tool belt is connected to said waist strap.

10. The safety harness and tool belt of claim 9 wherein said tool belt includes at least one carrying element and mounting means detachably mounting said carrying element to said waist band.

11. The safety harness and tool belt of claim 10 wherein said waist band is provided with a plurality of grommeted holes spaced therealong and wherein said mounting means comprises screw posts extended through said grommeted holes and through said carrying element for securing said carrying element to said waist band.

12. The safety harness and tool belt of claim 7 wherein said strap means of said harness includes a waist strap and waist strap connectors connecting said waist strap to said back strap and to said first and second connecting means; and wherein said waist strap connectors comprise a first pair of strap loops secured to said waist strap and to said back strap, and a second pair of strap loops secured to said waist strap and to said first and second chest straps.

13. The safety harness and tool belt of claim 12 wherein said harness includes releasable buckle means for joining said first and second chest straps to said shoulder strap chest segments and to said first and second back strap segments.

14. The safety harness and tool belt of claim 13 wherein said waist band of said tool belt is connected to said waist strap.

15. The safety harness and tool belt of claim 14 wherein said tool belt includes at least one carrying element and mounting means detachably mounting said carrying element to said waist band.

16. The safety harness and tool belt of claim 15 wherein said waist band is provided with a plurality of grommeted holes spaced therealong and wherein said mounting means comprises screw posts extended through said grommeted holes and through said carrying element for securing said carrying element to said waist band.

* * * * *